US007775360B2

(12) United States Patent
Bornemeier et al.

(10) Patent No.: US 7,775,360 B2
(45) Date of Patent: Aug. 17, 2010

(54) TREE COVER SYSTEM

(75) Inventors: Erik Bornemeier, Layton, UT (US); Jared Hendricks, Draper, UT (US)

(73) Assignee: TreeKeeper, LLC, West Valley, UT (US)

( * ) Notice: Subject to any disclaimer, the term of this patent is extended or adjusted under 35 U.S.C. 154(b) by 0 days.

(21) Appl. No.: 12/184,390

(22) Filed: Aug. 1, 2008

(65) Prior Publication Data

US 2008/0308440 A1 Dec. 18, 2008

Related U.S. Application Data

(63) Continuation-in-part of application No. 11/451,539, filed on Jun. 12, 2006, now abandoned.

(51) Int. Cl.
*B65D 85/50* (2006.01)

(52) U.S. Cl. ..... 206/423; 383/72; 383/81

(58) Field of Classification Search ..... 206/423, 206/303; 220/229; 428/12; 383/12, 26, 383/81, 72; 47/23.1, 23.2, 66.1
See application file for complete search history.

(56) References Cited

U.S. PATENT DOCUMENTS 633,528 A * 9/1899 Moore ..... 47/23.2
2,022,607 A * 11/1935 Sorensen ..... 47/76
3,750,731 A * 8/1973 Brimmell ..... 206/423
3,872,906 A * 3/1975 Bolanz ..... 206/423
4,206,795 A * 6/1980 Regan ..... 206/423
4,799,520 A * 1/1989 Blackburn et al. ..... 206/423
5,590,775 A * 1/1997 Moore ..... 206/423
2005/0150888 A1 * 7/2005 Birkmeier ..... 220/229

* cited by examiner

*Primary Examiner*—Mickey Yu
*Assistant Examiner*—Jenine M Pagan
(74) *Attorney, Agent, or Firm*—Kirton & McConkie; Michael F. Krieger

(57) ABSTRACT

Embodiments of the invention relate to reusable tree cover systems and methods that may be used with live trees or artificial trees. The cover systems may be stored in a pouch placed around the lower trunk of the tree from which the cover or tree bag is withdrawn and pulled up to substantially enclose the tree for transport and/or storage. The reusable systems may be designed to facilitate removal of the cover systems from the stored/covered tree while minimizing the undesirable forces on the tree and the cover system. This may be done by providing features that facilitate removing the cover systems in an upward direction relative to the tree along the stored/covered tree. As this removal direction is the same direction used to store/cover the tree in the first place and matches the natural bending/storing direction of the tree, storing and removal are facilitated by these systems.

18 Claims, 12 Drawing Sheets

TREE COVER SYSTEM

CROSS-REFERENCE TO RELATED APPLICATIONS

This application is a continuation-in-part of prior application Ser. No. 11/451,539, filed Jun. 12, 2006, now abandoned and entitled "Disposable Tree Cover System."

BACKGROUND

1. Field of the Invention

The present invention relates to a disposable tree cover system. More particularly, the present invention relates to an inexpensive collapsible cover configured for efficient transportation and storage of a tree that prevents shed needles or leaves of the tree from escaping the cover during transportation and storage.

2. Background of the Invention and Related Art

It has become tradition to raise and decorate a Christmas tree throughout the Christmas holiday. Part of this tradition involves lighting and displaying the tree in a well traveled location. Trees are typically decorated with ornaments, candy, and electrical lights, among other decorations.

Living trees shed leaves/needles once they are cut and typically deposit a large amount of these needles over the course of the holiday season. Shedding of needles occurs at all times after living trees are harvested: during transport, during display, and especially on cleanup at the end of the holiday season. Typically, the shedding worsens as time goes on and the tree dries out and dies. Living trees must be transported from the location where they are cut to a location where they are sold, and from there to the home or business of the purchaser for display. Because transport of trees is most convenient when trees are bundled up, trees are most often bundled shortly after harvesting. Most potential purchasers, however, want to see the tree they are buying before making a purchase, so trees are usually unbundled for display during sale.

After a sale has occurred, the buyer typically does not have the space to transport an unbundled tree, or does not desire the hassle. Therefore, trees are often bundled again into a smaller package for transport by individual tree buyers. The bundle is then opened or removed again by the purchaser after the purchaser transports the tree to the final display location. At each of these bundling/unbundling stages, the trees are bundled and unbundled by different entities: while one entity bundles the tree, another entity unbundles the tree.

A typical cut living tree cannot be used more than one season because it will dry out and die. Therefore, living trees must also be disposed of at the end of the season. However, living trees are typically driest at the end of the season, and so the handling of living trees for disposal leads to additional and/or increased shedding of needles requiring cleanup. Therefore, many people wish to bundle the tree in a way that prevents the inevitable shed needles from spreading all over the location where the tree was displayed and during transport for disposal.

Similar problems may be encountered with artificial trees. In the case of artificial trees, the problem is usually not that the tree sheds leaves and needles. Instead, the user of an artificial tree usually desires to store the tree from year to year to reuse the tree the next year. In doing so, the user may not desire to remove all the decorations one year only to have to restore all the decorations the next year. Or the user may want to have all components of the artificial tree stored in the same convenient package to ensure that no parts are lost, as most artificial trees include multiple parts and sections. Artificial trees can be bulky to store, so the user of an artificial tree may want to have a storage bag that can reduce the volume of the artificial tree to be stored.

If a storage bag used to store/transport/bundle a live tree is to be reused and/or removed from a live tree (such as for display), it is disadvantageous for the removal process to involve applying forces to the tree's branches in a downward direction. When a tree is bundled, stored, and/or transported, its volume is typically reduced by applying an upward force on the branches of the tree to reduce the tree's overall diameter and volume. In the case of a live tree, the branches are typically sufficiently flexible in an upward direction to permit the tree's volume to be significantly reduced. In the case of an artificial tree, many artificial trees are provided with hinges that permit the tree's branches to hingedly bend upward and reduce the volume. If a downward force is then applied to the branches of a live tree (i.e. during removal of the storage system), it may cause large-scale shedding, damage to the tree, and/or catching/tearing of the storage system. If a downward force is applied to the branches of an artificial tree (during removal of the storage system), it may cause breakage of the branches, dislodgement of any stored decorations, damage to the storage system, etc. However, existing storage systems are primarily designed to be removed from the trees in a downward direction, leading to the exact problems discussed above.

SUMMARY OF THE INVENTION

Implementations of the present invention relate to inexpensive disposable tree cover systems particularly useful for enclosing trees to catch shed leaves and needles. The disposable tree cover system includes a pouch that may be attached at the base of the trunk of the tree, the pouch containing a bag that may then be extended up and around the tree to provide a shed-proof enclosure for the tree. The material forming the cover system may be inexpensive fabric, cloth, or plastic. If the material is strong enough, handles may be provided on the enclosure to facilitate handling of the tree. The handles also facilitate manipulating the cover system during enclosure of the tree. The disposable tree bay may also be used in other areas, such as shipping of live trees, where the bag would serve as protection for the tree. If desired, the bag may be manufactured of sturdier material so as to be reusable instead of disposable. When manufactured of sturdier material, the bag may be advantageously used as a storage bag for artificial trees. The bag may also be provided with circumferential straps to allow the bag to be cinched to reduce the volume contained within the bag.

Alternate implementations of the present invention relate to reusable tree cover systems that may be used with live trees or artificial trees. The reusable systems may be designed to facilitate removal of the cover systems from the stored/covered tree while minimizing the undesirable forces on the tree and the cover system. This may be done by providing features that facilitate removing the cover systems in an upward direction along the stored/covered tree. As this removal direction is the same direction used to store/cover the tree in the first place and matches the natural bending/storing direction of the tree, storing and removal are facilitated by these implementations.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

That the manner in which the above-recited and other advantages and features of the invention are obtained may be understood, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative and not restrictive. The scope of the invention is, therefore, indicated by the appended claims rather than by the description and the appended Figures, which are expressly incorporated into this description by reference. All changes that come within the meaning and range of equivalency of the claims are to be embraced within their scope.

Embodiments of the present invention relate to inexpensive disposable tree cover systems. One embodiment is directed at a disposable Christmas tree cover system that may be attached at the base of the trunk of the tree then extended up and around the tree to provide a substantially-shed-proof enclosure for the tree. In one embodiment the material forming the enclosure is fabric. In another embodiment, the material is plastic. If the material is strong enough, handles may be provided on the enclosure to facilitate handling of the bundled tree. While embodiments of the present invention are directed at a disposable Christmas tree cover system, it will be appreciated that the teachings of the present invention are applicable to other areas. For example, another embodiment of the tree cover system is made of stronger material so as to be made reusable for use as a storage bag for an artificial tree.

Alternate embodiments of the present invention relate to reusable tree cover systems that may be used with live trees or artificial trees. The reusable systems may be designed to facilitate removal of the cover systems from the stored/covered tree while minimizing the undesirable forces on the tree and the cover system. Such embodiments include features that facilitate removing the cover systems in an upward direction along the stored/covered tree. As this removal direction is the same direction used to store/cover the tree in the first place and matches the natural bending/storing direction of the tree, storing and removal are facilitated by these embodiments.

As used in herein, the following terms are defined accordingly:

"tree"—any living or artificial tree including cut living trees, living trees with a living root ball, and a Christmas tree, except as the specific embodiment being discussed is clearly not workable with a particular tree of the trees set forth herein;

"tree cover"—a properly-shaped cover configured to substantially cover the exterior of a tree;

"bag"—a bag, cover, enclosure, or other structure designed to substantially cover the exterior of a tree;

"skirt"—a flexible or semi-flexible material draped around the trunk of a tree near the base of the tree; and "elastically-biased opening"—is an opening that is biased into a closed configuration with some form of elastic device.

Figure 1A:
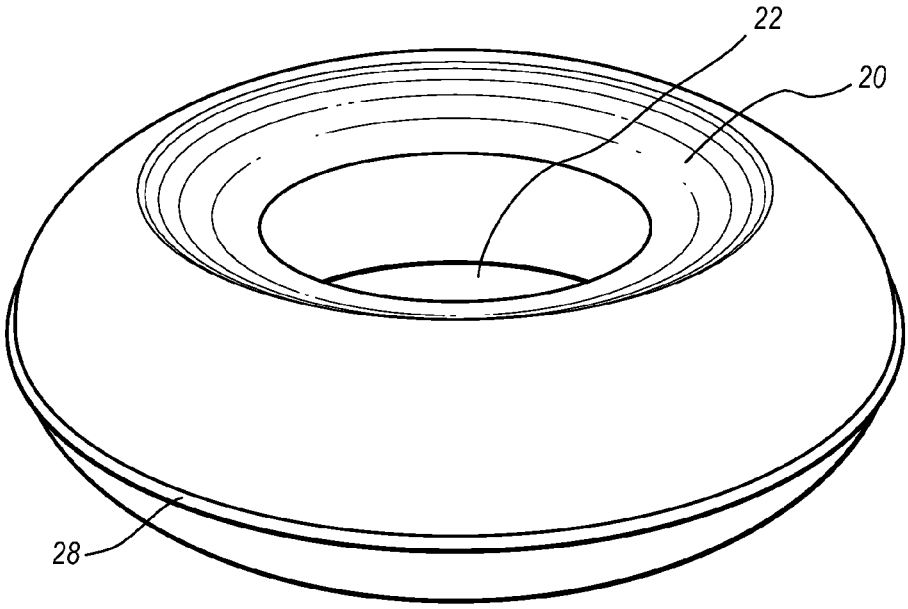
FIG. 1A illustrates a perspective view of an embodiment of a storage pouch for the bag to be placed about a trunk of a tree.
Figure 1B:
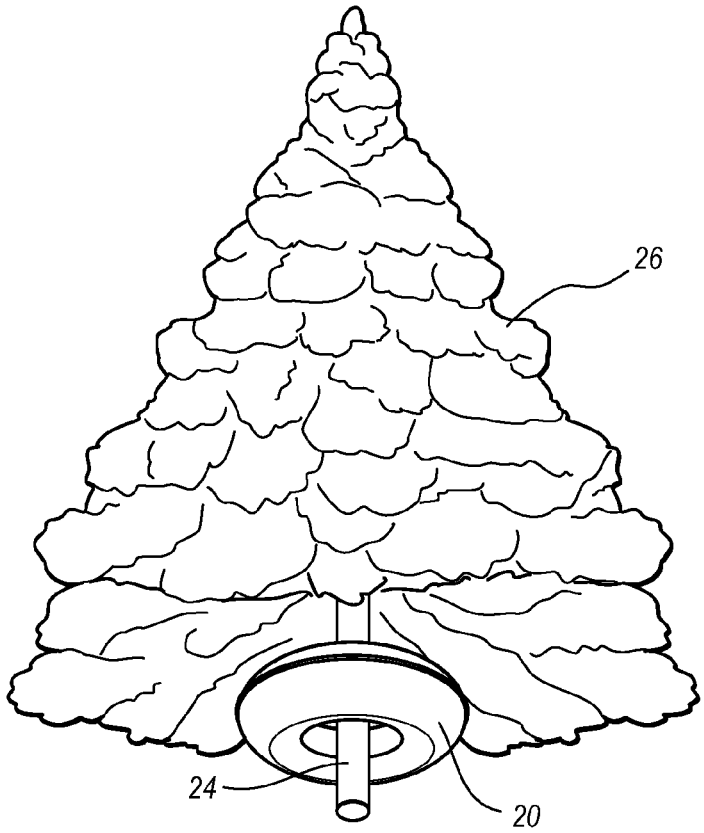
FIG. 1B illustrates a perspective view of the embodiment of FIG. 1A placed around the trunk of a tree.

Reference will now be made to the Figures to describe embodiments of the present invention. Reference is initially made to FIG. 1A, which illustrates a perspective view of a pouch or package 20 (hereinafter "pouch 20") that initially contains the tree storage bag or tree storage cover. Pouch 20 may be made of any inexpensive disposable material, and may assume any number of configurations that maintains the functionality of the tree cover or bag. Pouch 20 may also be made of a more durable material, such as for embodiments not to be disposable. In FIG. 1A, the pouch 20 is shown as having a round shape with a center hole 22 configured to accept a trunk 24 of a tree 26, so that the pouch 20 may be fitted about the trunk 24 of the tree 26, as shown in FIG. 1B. The material of pouch 20 may be somewhat flexible, allowing the pouch 20 to stretch or bend as needed to fit about the trunk 24 of the tree 26.

Because the pouch 20 of the embodiment shown in FIG. 1 slips on the trunk 24 of the tree 26 from the bottom, it is anticipated that the pouch 20 may be placed on the trunk 24 of the tree 26 at some point after the tree 26 has been cut, but at some point where the tree 26 is not currently located on or attached to a stable base (not shown) commonly used to support cut trees 26, such as Christmas trees, for display during sale or as a decoration. For example, a tree retailer might place the pouch 20 containing the bag elements on each tree 26 prior to displaying the trees for sale, and might advertise that the tree is sold with the attached pouch and bag to facilitate later tree cleanup, as described below. Alternatively, a homeowner purchasing a Christmas or other decorative cut tree 26 might also purchase a pouch 20 containing a tree bag, then place the pouch 20 around the tree trunk 24 prior to placing the tree 26 on its display base or stand (not shown).

Finally, the pouch 20 might also be placed on the tree trunk 24 at the end of the season when the tree is being taken down for disposal.

While this method of placing the pouch 20 on the tree 26 has certain advantages of simplicity and continuity of the eventual bag, cover, or enclosure to surround the tree, it is anticipated that in certain situations other forms of pouches 20 might be desired. For example, a pouch 20 might be provided that forms a tube shape instead of the circular shape shown in FIG. 1. In this embodiment, the tube shape could be wrapped around the trunk 24 of the tree 26, even while the tree is in a tree stand or even before a live tree is cut. This embodiment could also be used for uncut live trees, such as trees intended to be planted/replanted after an indoor display season. The two ends of the tube shape would be close to each other after the tube shape is wrapped around the trunk 24, so that the tube shape approximates the circular donut shape shown in FIG. 1. Other shapes of the pouch 20 could also be advantageously used, depending on the particular situation, as may be appreciated by one skilled in the art.

For example, although the pouch 20 may be designed to be disposable, it is appreciated that some people are willing to pay additional costs for designer products. Therefore, to satisfy such needs, the pouch 20 might be provided in a number of decorative shapes or colors to satisfy those individual needs. This might be especially desirable since the pouch 20 may be designed to remain attached to the tree throughout its display period. Thus the pouch 20 might form a triangle, square, star, or other shape to fit the purchaser's festive needs and whims. This is possible since the pouch 20 essentially serves two basic functions: to secure the bag elements to the tree 26 and to provide storage of the other bag elements. As long as the pouch 20 performs these two functions, it may assume any shape desired.

Figure 2:
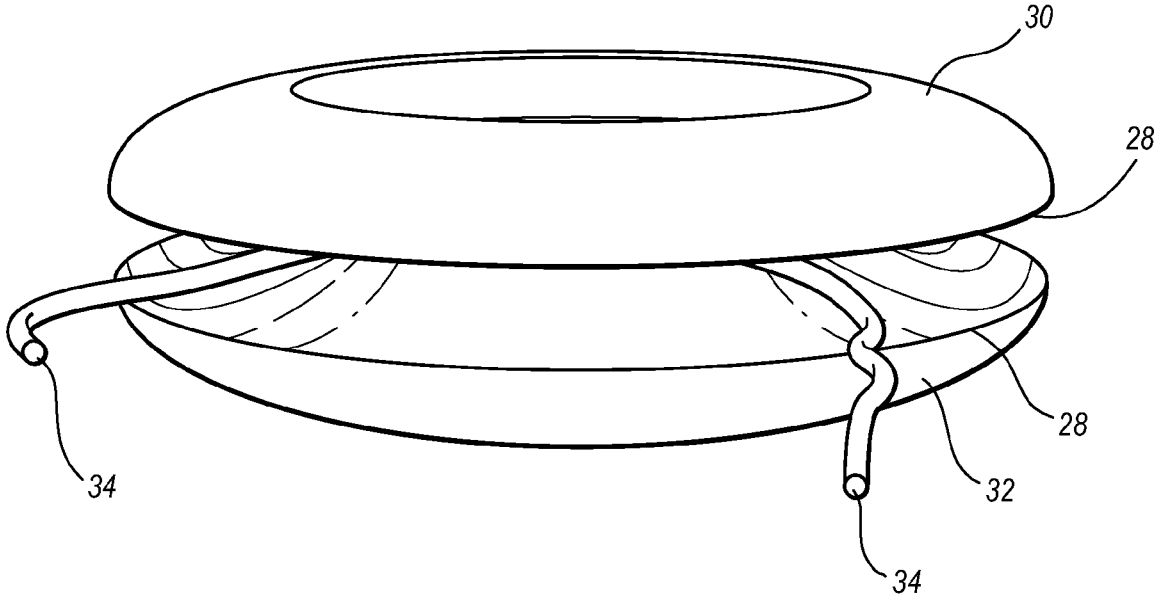
FIG. 2 illustrates a perspective view of an opened pouch from FIG. 1.

As seen in FIG. 1A, the pouch 20 has a rim 28. In this embodiment, the rim 28 is located approximately at the outermost radial portion of the pouch 20. The rim 28 extends the entire circumference of the pouch 20. The rim 28 provides a location for accessing the contents of pouch 20. To achieve this, a zipper (not shown) may be placed at rim 28. Alternatively, if the pouch is desired to be disposable, the rim 28 may be designed so as to be weaker than the remainder of the pouch 20, and access to the contents of the pouch 20 may be achieved by tearing the pouch 20 at the rim 28. After unzipping the zipper or tearing the rim 28, the pouch 20 may be opened as may be seen in FIG. 2. For clarity, FIG. 2 shows an opened pouch 20 as it might be found on the trunk 24 of the tree 26 without showing the trunk 24 or the tree 26. Once the pouch 20 is opened at rim 28, the pouch 20 may be split into two halves, an upper half 30 and a lower half 32. These two halves 30, 32 are still joined near the trunk 24 of the tree 26. While FIG. 2 shows the pouch 20 split symmetrically at rim 28, one of skill in the art can readily recognize that rim 28 may be provided at any location that adequately provides access to the contents of the pouch 20, whether vertically symmetrical or not.

Inside the pouch 20 may be found a pouch drawstring 34. The pouch drawstring 34 may be attached to the pouch 20 near the trunk 24 of the tree 26 in such a way as to encircle the trunk 24. The pouch drawstring 34 may be used to tightly tie the pouch 20 to and around the trunk of the tree, so that once the bag is placed over the tree no needles or leaves may escape the bag at the bottom by slipping between the pouch 20 and the trunk 24. Alternatively, the center hole 22 of the pouch 20 may be provided with an elastic member so that the center hole 22 forms an elastically-biased opening to provide a secure attachment to the tree and to prevent shed needles or leaves from escaping. In configurations where the pouch 20 is tied around the tree, such as the tube-pouch configuration, the pouch drawstring 34 may also serve to secure the pouch 20 around the trunk 24 so as to form the round shape described. Any of these means described can serve as a means for securing the pouch to the trunk of the tree.

Also located within the pouch 20 is a bag material 36. The bag material 36 may be bunched up or rolled up so as to fit within the pouch 20. The bag material 36 may be attached to the pouch 20 within the pouch 20 so as to be secured to the trunk 24 directly or through the pouch 20. Alternatively, the bag material 36 may be attached to the pouch drawstring 34 to achieve the same effective attachment. Another alternative attachment would be to have the bag material 36 form a unitary part of the pouch 20 so that the bag material 36 is merely an extension of pouch 20. In any event, bag material 36 is formed so as to encircle the tree trunk 24 and tree 26 when in its fully-extended configuration so as to form a bag, cover, or enclosure around the tree 26. The bag material 36 may be made of any material known in the art, whether inexpensive or otherwise, including plastic, cloth, and fabric, depending on the cost and strength needs for the eventual bag. In instances where the user anticipates reusing the bag, such as for use with an artificial tree, the bag material 36 may be chosen so as to be a more expensive and more durable material. The bag material 36 may also be chosen to be a flexible material to provide optimum flexibility as the bag is extended around a tree as described below.

Figure 3:
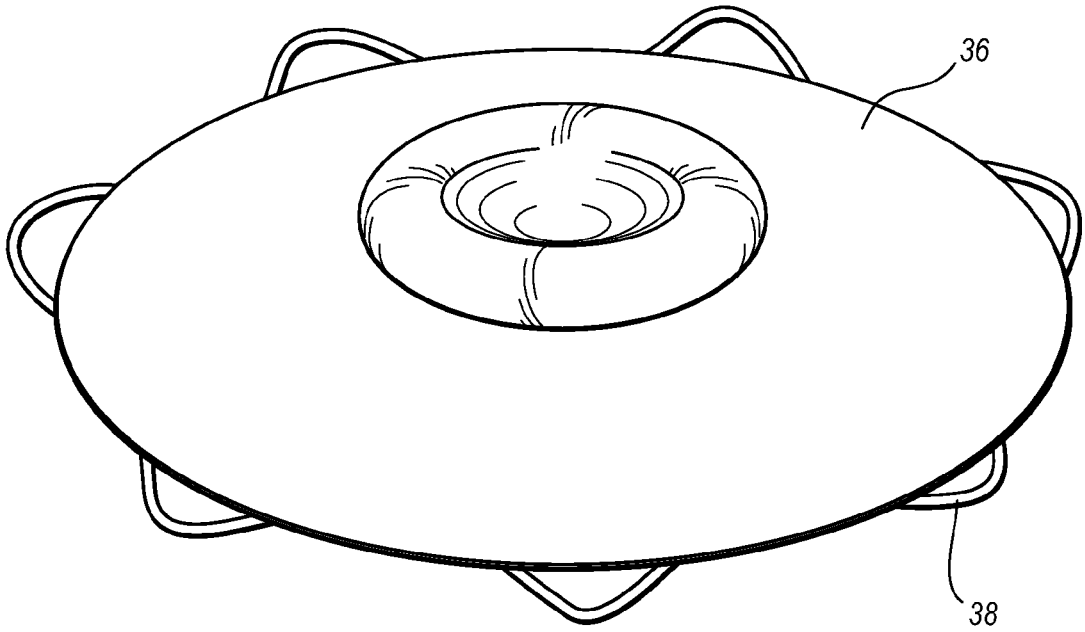
FIG. 3 illustrates a perspective view of a pouch with tree bag material extending horizontally from the pouch.

To reach its fully-extended configuration so as to form the bag around the tree 26, the bag material 36 may be withdrawn horizontally around the tree to assume the configuration shown in FIG. 3. As shown in FIG. 3, the bag material 36 may be provided with handles 38 to facilitate withdrawing the bag material 36 from the pouch 20 into the horizontally-extended configuration shown. In this configuration, the bag material 36 may serve to form a skirt around the tree for decorative purposes and to catch shed leaves or needles during display of the tree 26. Therefore, the bag material 36 may optionally be provided with decorative markings or be manufactured of an eye-pleasing fabric and color for use during display as a skirt, allowing the bag material 36 to serve as a skirt for an extended period of time.

Figure 4:
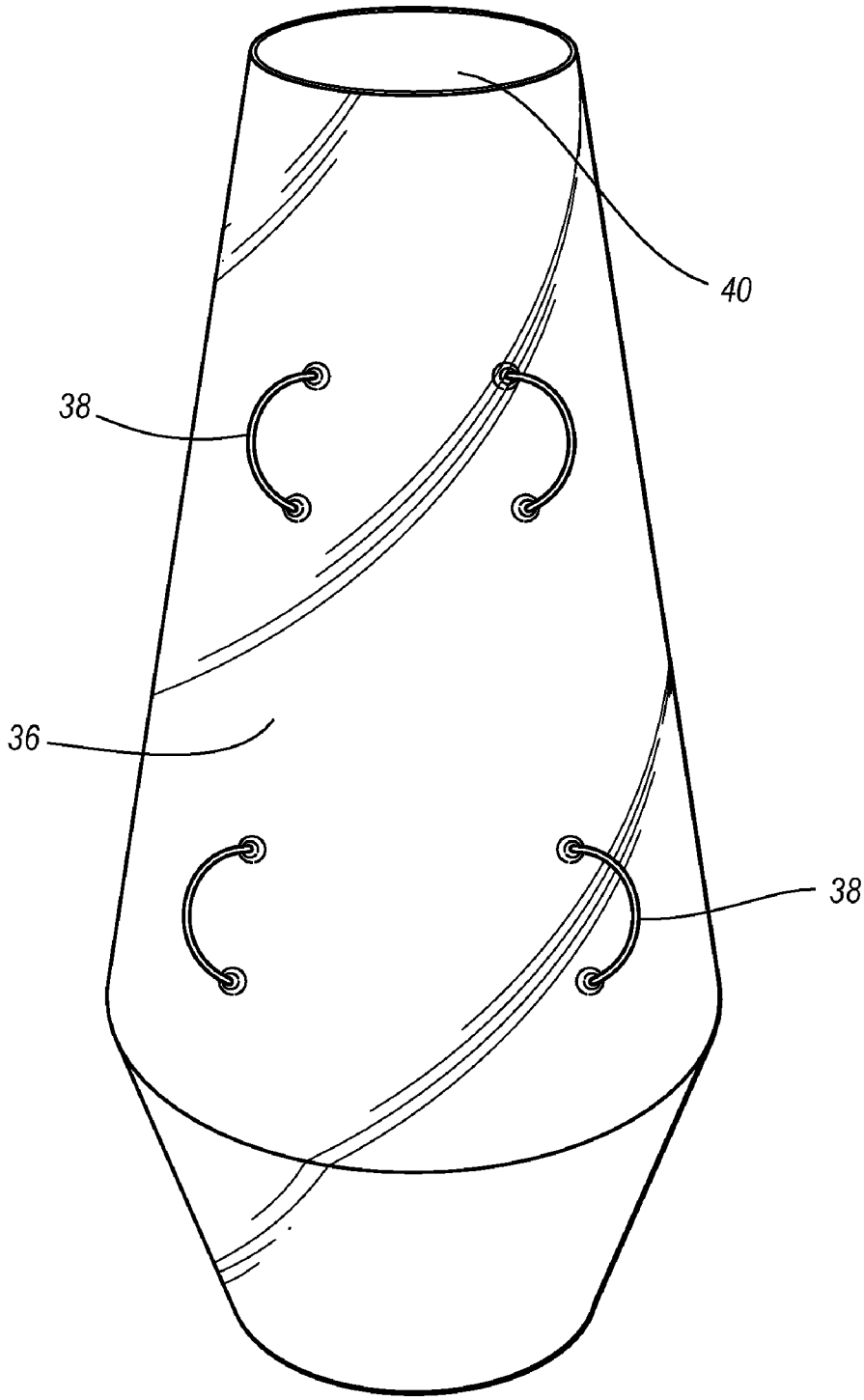
FIG. 4 illustrates a perspective view of a tree bag extended fully to substantially enclose a tree.

From the horizontally-extended configuration of the bag material 36, the handles 38 may serve an additional purpose to assist in moving the bag material 36 to its fully-extended configuration shown in FIG. 4. When it is time to enclose the tree 26 in a bag for transport or disposal, the bag material 36 or the handles 38 may be grasped to manipulate the bag material 36 so as to extend upward to substantially surround the tree 26. In this way, the bag material 36 forms a bag beginning at or near the base of the trunk 24 and extending outward and upward to substantially enclose the tree 26. As seen in FIG. 4, when the bag is pulled up over the tree a top opening 40 remains. The top opening 40 may be closed by any means known in the art, such as by tying a string or cord similar to pouch drawstring 34, or by providing an elastic element in top opening 40 so that top opening 40 forms an elastically-biased opening. Because the tree bag may be designed to be disposable, the top opening 40 may also be closed by other closing means, such as stapling, cinching, folding over, hook-and-loop closure systems, or any other bag closing means known in the art.

As may be seen in FIG. 4, the bag formed by bag material 36 may begin at a narrow base surrounding the trunk 24, may flare outward to enclose the larger lower branches of the tree 26, and then may taper upward to the top opening 40. The bag material is formed or stitched to assume this final fully-extended configuration. However, any number of possible final shapes may be formed and are contemplated as functional depending on the needs of the user. For example, the bag material 36 may be formed into an essentially-cylindrical bag, and the bag may merely be bunched at the top and bottom as needed to close the bag. This may be advantageous in making it easier to pull the bag material 36 over the tree, and may also simplify manufacture. Alternatively, the bag material 36 might be shaped differently to accommodate differently-shaped trees than the standard Christmas tree. In one example, the bag might be used to protect live trees during shipping. In such a circumstance, the pouch used might be of the tube-shaped variety described above, and the bag thus formed would have a slit extending upward along the side of the bag that could optionally be closed by means of a zipper, ties, snaps, or other closure mechanisms. The bag material 36 might then be shaped and sized to form a bag roughly conforming to the shape and size of the live tree's branches, whatever that shape and size might be.

The bag material 36 may also be provided with circumferential straps (not shown) that may be used to cinch down the bag formed to make a smaller, tighter package for transport. This may be useful for use with artificial trees to reduce the volume of the stored artificial tree. This may also be especially useful to get a tree through a tight opening, such as up or down a stairwell, or out a door. To make the circumferential strap inexpensive, it may be replaced with twine provided as part of bag material 36 or separately. In circumstances where bag material 36 is sufficiently strong, the enclosed tree 26 may be carried by using the handles 38 or by using the circumferential strap or string. Thus the handles 38 may serve a multitude of purposes during use of the bag.

Several methods of using embodiments of the bag will now be described. In a first method of using the bag, the pouch 20 is placed on the trunk 24 of the tree 26 as shown in FIG. 1B. Then the tree 26 is placed in a display stand, as is commonly known in the art. The tree 26 is displayed thus throughout the holiday season, and when the season comes to an end and the tree 26 is to be disposed of, any decorations to be saved are removed from the tree. Then pouch 20 is opened at rim 28, and the pouch drawstring 34 is secured to the trunk 24 of the tree 26, if a pouch drawstring 34 is provided. Bag material 36 is withdrawn from pouch 20 horizontally until it is spread out around the tree 26 as in FIG. 3, and then one or more people grasp the bag material 36 (or handles 38 if provided) and pull the bag material 36 upward to surround the tree 26. It is anticipated that using several people to pull the bag material 36 upward may help prevent jostling that might lead to unwanted shedding before the bag is in place in some instances. The top opening 40 is then closed, the tree is removed from its display stand, and the tree may be transported for disposal. The bag formed by bag material 36 serves to trap any shed needles or leaves, making removal and transport of the tree a much cleaner process than is currently available.

In another method of use, the pouch 20 is placed on the trunk 24 of the tree 26 as before, and the tree 26 is placed in its display stand. Then the pouch 20 is opened, and the pouch drawstring 34 secured as previously described. The bag material 36 is pulled out horizontally to form a skirt around the tree 26, as in FIG. 3, and then the tree is decorated and displayed. The bag material 36, used as a skirt, serves to catch any leaves or needles shed during display. When the period of display is over, the decorations are removed as described above and the bag material 36 is pulled upward and closed to form a bag as described. The tree 26 may then be removed from its display stand for transport and disposal of the tree 26, without fear of messy spread of shed needles or leaves.

The tree bag may also be used even after display of the tree 26. The tree 26 is simply removed from its display stand, and then the pouch 20 is attached to the trunk 24, the bag material 36 withdrawn and extended to enclose the tree 26, and the bag closed for transport. Although this may be less advantageous than the previous methods in some instances because the tree must be handled before being enclosed in the bag (leading to some dispersal of shed needles or leaves), this is still more advantageous than fully moving around an unbagged tree at the end of a display season.

If a tube-type pouch 20 is used, it may be secured around the trunk even while the tree is in its display stand. This may be advantageous when a bag is desired but was not attached prior to placing the tree in its stand. It also may be advantageous when an uncut live tree is used. Although this type of bag has a slit in it, it may be closed as described above to prevent the escape of needles, or the bagged tree may be carried and transported with the slit upward so as to prevent shed needles and leaves from dispersing.

Although the described bag is advantageous for situations where a disposable bag is desired, the described bag may also be made in a reusable fashion. The rim 28 may be provided with a zipper instead of being torn, and the bag material 36 and pouch 20 may be manufactured of a stronger, more durable material. This allows the bag to be used then stored again within the pouch 20 for future use. This may be particularly advantageous for use with artificial trees. In use with artificial trees, the bag becomes a storage bag instead of a needle-catching bag. A bag of this type might be used to prevent loss of decorations or essential tree parts.

Even a disposable bag may be reused in some instances. This may occur, for example, if a tree is initially bagged after cutting for transport to a point of sale. The tree may be unbagged and the bag stored in the pouch 20 during sale. Upon sale, the bag may be redeployed for transport to the purchaser's home. Upon arriving in the purchaser's home, the tree may be unbagged, displayed, and re-bagged for disposal, as described above. Or the bag might be used for only one or two of the above-described uses. A disposable bag may even be used for multiple trees if desired, such as a single bag used for multiple live trees within a house, the bag being used at all times within the house and then removed once the trees have been removed from a location where shedding is particularly undesirable. Thus it may be seen that the disposable-type bag is flexible and useful in a variety of situations.

Figure 5:
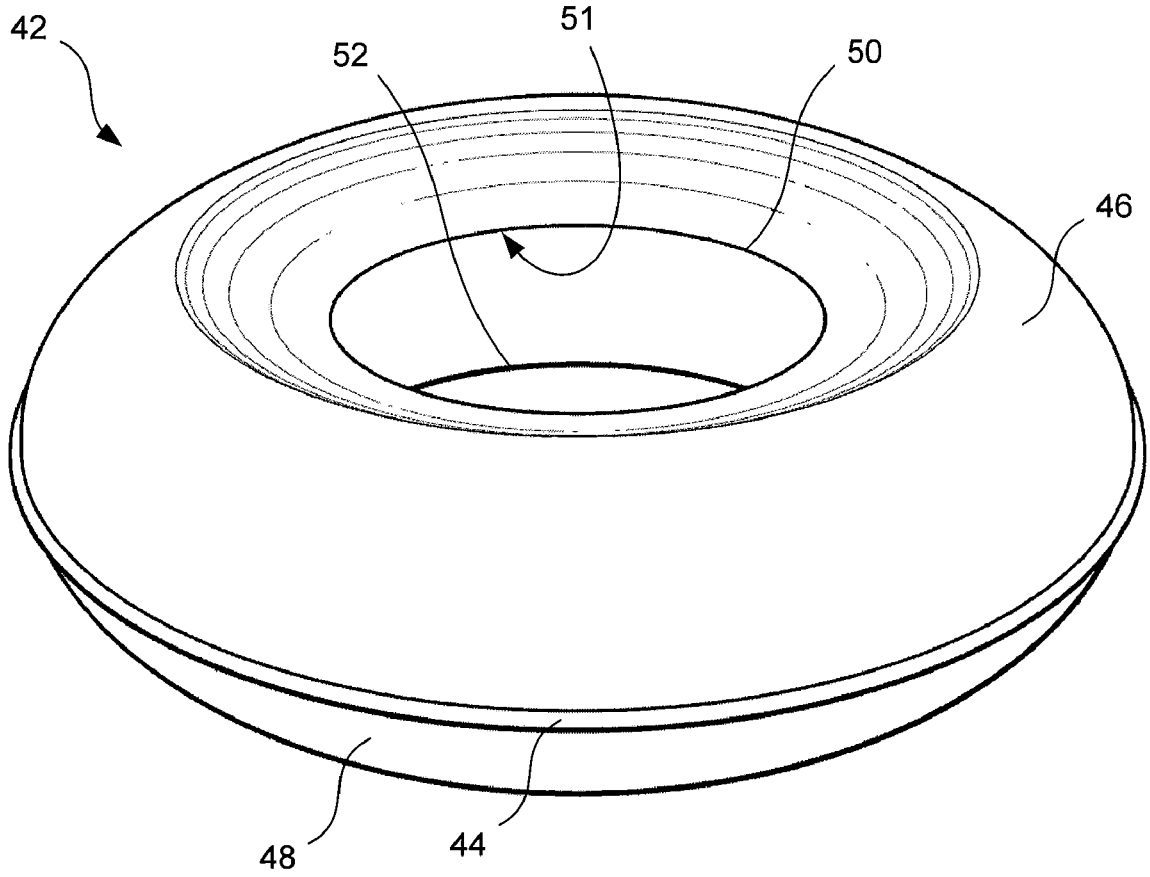
FIG. 5 illustrates a perspective view of another embodiment of a pouch for use with a reusable tree bag system.

In other situations, various embodiments of a reusable bag may be desirable. One alternate embodiment of a reusable bag system is illustrated in FIGS. 5-13. This embodiment includes a pouch 42, as illustrated in FIG. 5, that may be similarly shaped to the pouch 20 discussed above. The pouch 42 may be manufactured in any desired shape and of varying materials, but it is anticipated that the pouch 42 be manufactured of a durable and flexible material. In at least some embodiments, the pouch 42 may be manufactured of a machine-washable material. The pouch 42 may include a rim 44 connecting an upper half 46 and a lower half 48, or the pouch 42 may be manufactured in a unitary fashion without a rim 44. If a rim is present in this type of embodiment, it is not openable or tearable as with the rim 28 discussed above.

The upper half 46 includes an upper half center hole 50, while the lower half 48 includes a lower half center hole 52. The upper half center hole 50 and the lower half center hole 52 serve to receive the trunk 24 of the tree 26, similar to the fashion discussed above. The upper half center hole 50 and the lower half center hole 52 may be provided with an elastic material to permit the upper half center hole 50 and the lower half center hole 52 to be significantly stretched. For example, in one embodiment, the upper half center hole 50 and the lower half center hole 52 may be stretched between three to four times in size, such as from about three inches in circumference to about ten inches in circumference. Alternatively or additionally, the upper half center hole may include an elastic closing mechanism 51 that biases the upper half center hole closed around the trunk. The purposes of the ability of the upper half center hole 50 and the lower half center hole 52 to stretch will become more apparent below, and all ranges of elasticity that provide the features and purposes discussed herein are embraced by the embodiments of the invention. For example, larger systems may be provided for larger trees 26 and/or larger trunks 24, and such changes will be readily apparent to those of skill in the art.

Figure 6:
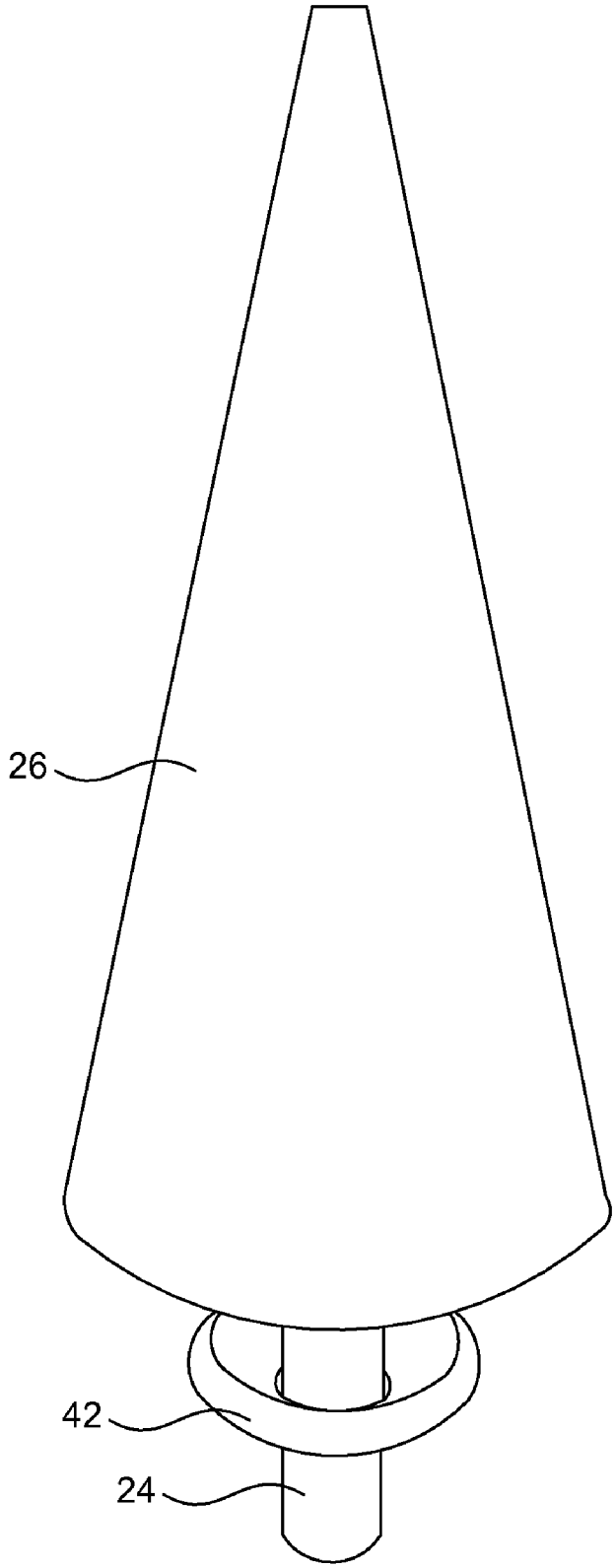
FIG. 6 shows an illustrative perspective view of the pouch of FIG. 5 on a tree.

The pouch 42 contains a tree bag or tree cover (hereinafter "tree bag 54") that may be similar in many respects to the bag formed from the bag material 36 discussed above. Therefore, the pouch 42 may be placed on the trunk 24 of the tree 26, by stretching the upper half center hole 50 and the lower half center hole 52 sufficiently for the lower end of the trunk 24 to pass through the upper half center hole 50 and the lower half center hole 52. When the tree bag 54 is desired to be placed so as to contain the tree, the upper half center hole 50 may be stretched as shown in FIG. 6 and the tree bag 54 may be pulled out from the pouch 42. The tree bag 54 is connected to a portion of the pouch 42, and surrounds the trunk 24 of the tree 26 when the tree bag 54 is within the pouch 42.

Figure 7:
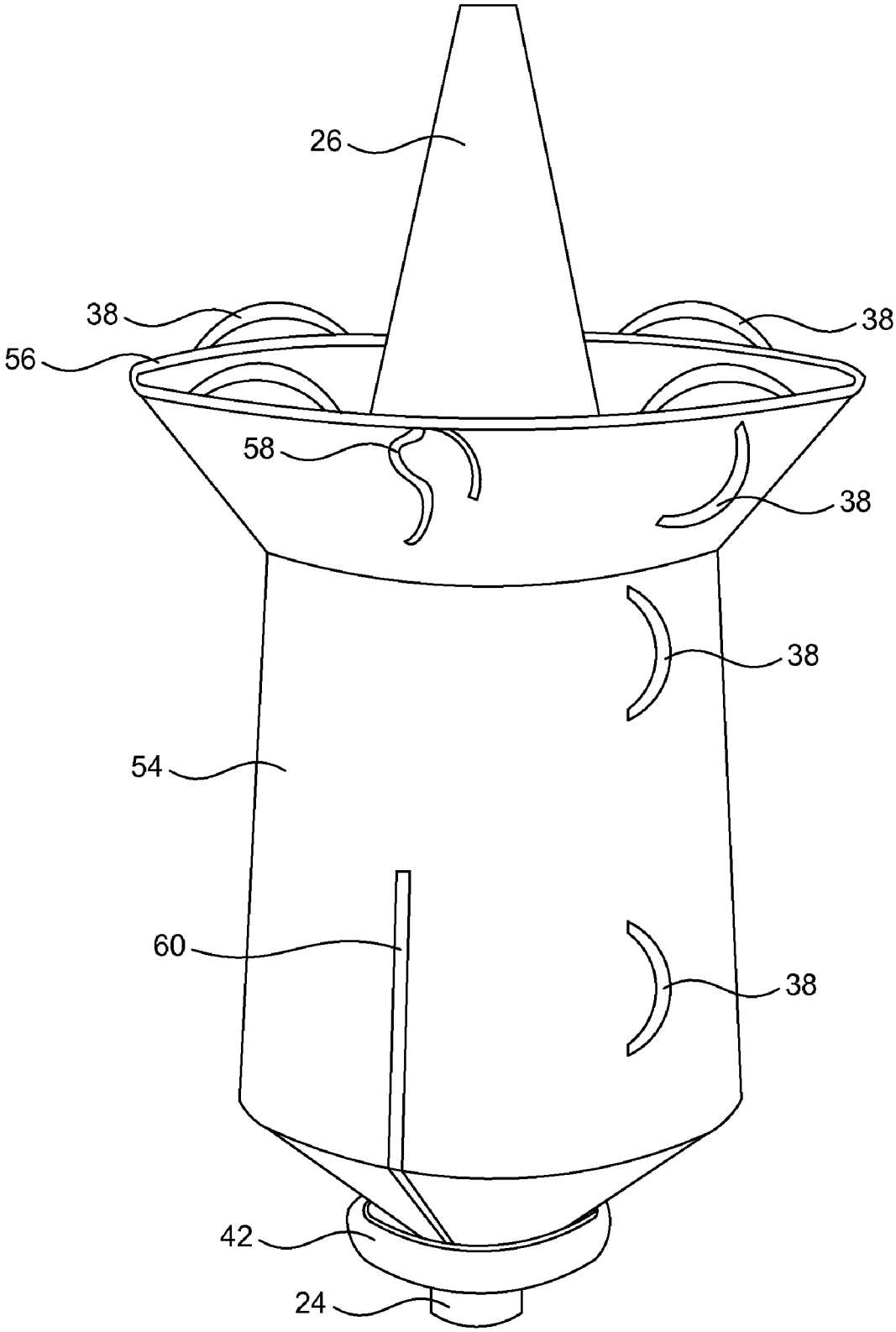
FIG. 7 shows a perspective view of a reusable tree bag being drawn upward over a tree.

The tree bag 54 may be pulled upward from the pouch 42 to substantially surround the tree 26, as is shown in FIG. 7. The tree bag 54 may have a top opening 56 that allows this procedure to occur. It should be appreciated that the branches of most trees, whether artificial or cut live trees, relatively easily bend or flex upward, so the procedure of raising the tree bag 54 to encompass the tree 26 is facilitated by this bending or flexing. In some instances, this procedure may substantially reduce the diameter of the tree 26, as the diameter of the tree bag 54 may be significantly smaller than the diameter of the tree 26 (when the branches are fully relaxed or deployed). In at least some embodiments, the top opening 56 and a portion of the tree bag 54 may be elastic and/or otherwise permitted to be of somewhat larger diameter than the remaining diameter of the tree bag 54 to assist in raising the tree bag 54 over the tree 26. This is illustrated in FIG. 7. In some embodiments, the top opening 56 may be provided with handles 38, as set forth with respect to previously-discussed embodiments, to assist in raising the tree bag 54 and/or in carrying a bagged tree 26.

The top opening 56 may be provided with an elastic closure, one or more ties 58, and/or some other closure mechanism to assist in closing the top opening 56 to substantially contain the tree within the tree bag 54. The tree bag 54 may also be provided with a lower vertical opening 60 that may be substantially vertically placed at the bottom of the tree bag 54. The lower vertical opening 60 may extend upward along the tree bag 54 from the pouch 42 to a point medially vertically located along the tree bag 54, such as to a position approximately one-quarter to one-half vertically up the side of the tree bag 54. The lower vertical opening 60 may be a slit lacking a particular closing mechanism, but to better contain the tree 26 and any needles (cut tree) or ornamentation (artificial tree) of the tree 26, the lower vertical opening 60 may include a reversible closing means, such as a zipper, a plurality of snaps or buckles, or a hook-and-loop fastener system. Any other fastener system currently known or invented in the future may be used as a reversible closing means for reversibly closing the lower vertical opening 60. The purpose of the lower vertical opening 60 will become apparent below.

Figure 8:
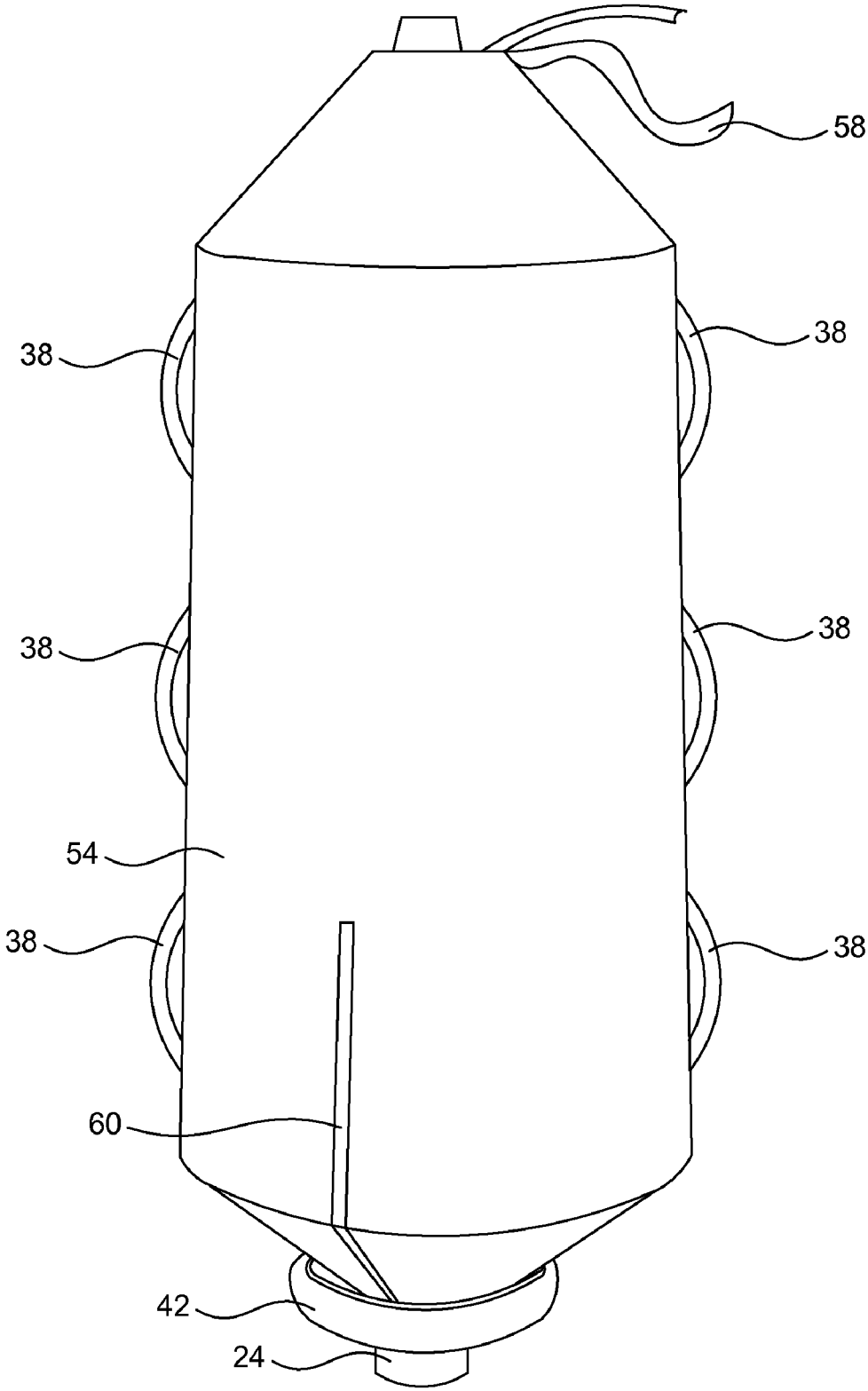
FIG. 8 shows a perspective view of a reusable tree bag substantially enclosing a tree.

When the tree bag 54 substantially encompasses the tree 26, it may appear as illustrated in FIG. 8. The ties 58 or other closure mechanism for the top opening 56 may have been actuated to close the top opening 56, and the tree bag 54 may therefore be prepared to contain the tree for transport or storage with a reduced likelihood that needles, ornaments, etc. will fall off the tree. In this configuration, the tree bag 54 and tree 26 may be picked up and transported vertically or horizontally (such as by the handles 38). Once the tree has been transported to a disposal location (for a live tree) or has been retrieved from storage to be displayed again (artificial tree), it may be desirable to remove the tree 26 from the tree bag 54. Several features of the tree bag 54 may assist in this process.

Figure 9:
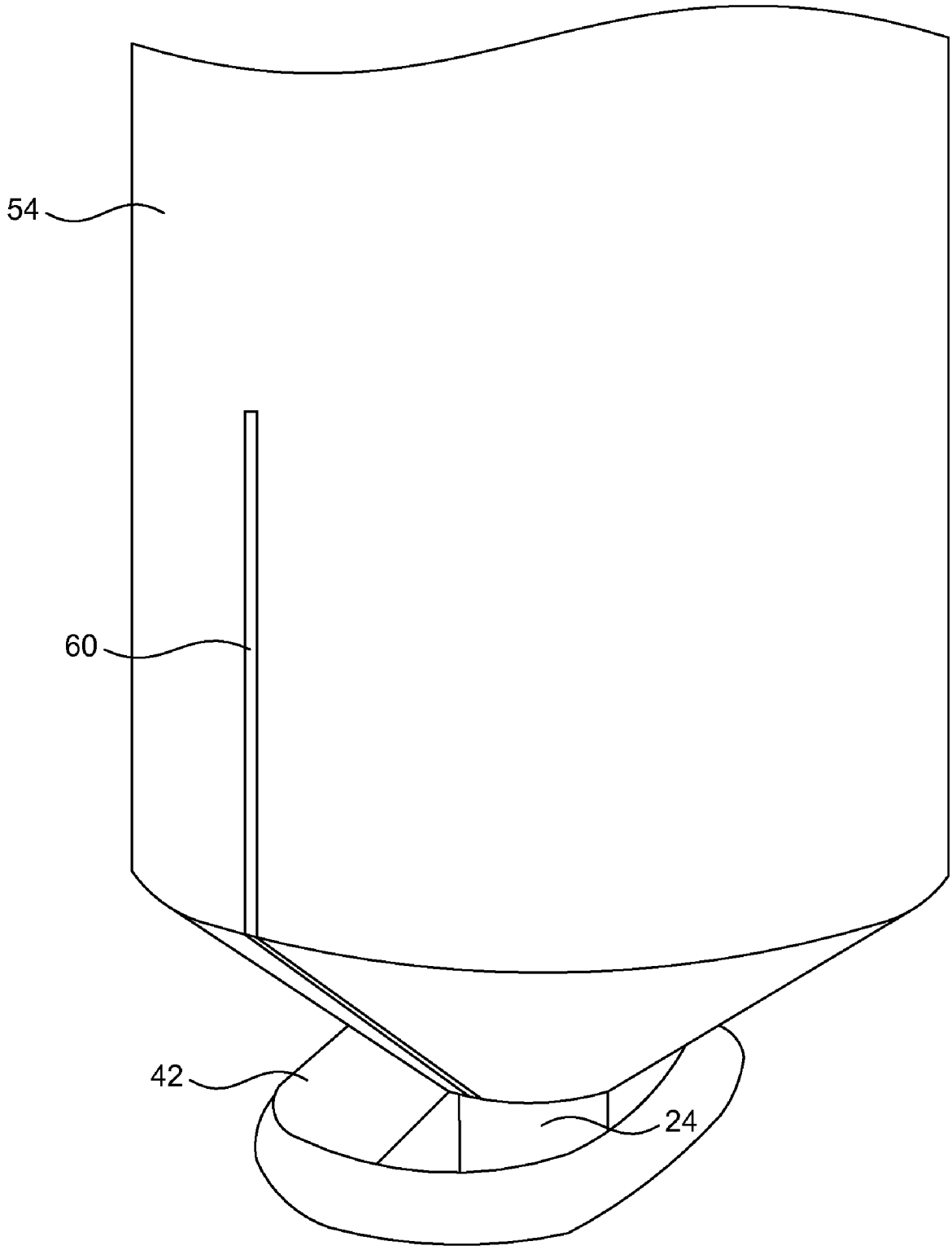
FIG. 9 shows a perspective closer view of features of a tree bag and associated pouch.

For example, it may be easier to remove the tree bag 54 in an upward direction. Removing the tree bag 54 in an upward direction takes advantage of the natural bending of the tree branches, where removing the tree bag 54 in a downward direction might be hindered in some instances by snagging of the tree bag 54 on the branches. The tree bag 54 may include features that facilitate removal of the tree bag 54 from the tree 26 in an upward direction. The lower vertical opening 60 is one such feature, and additional features may be incorporated into the pouch 42, as illustrated in FIG. 9. As has been discussed previously, the pouch 42 may include a substantially-elastic material. This may permit the pouch 42 to stretch as is illustrated in FIG. 9. Additionally, the pouch 42 may only be attached to the tree bag 54 along a portion of the lower edge of the tree bag 54 and a corresponding portion of the pouch 42, as may also be seen in FIG. 9. Thus, when the time comes to remove the tree bag 54 from the tree, the pouch 42 may be grabbed and stretched, and may thereby pass over the bottom of the trunk 24, releasing the pouch 42 from the tree 26. This removal of the pouch 42 from the trunk 24, in conjunction with the lower vertical opening 60 permits relatively easy removal of the tree bag 54 in an upward direction.

Figure 10:
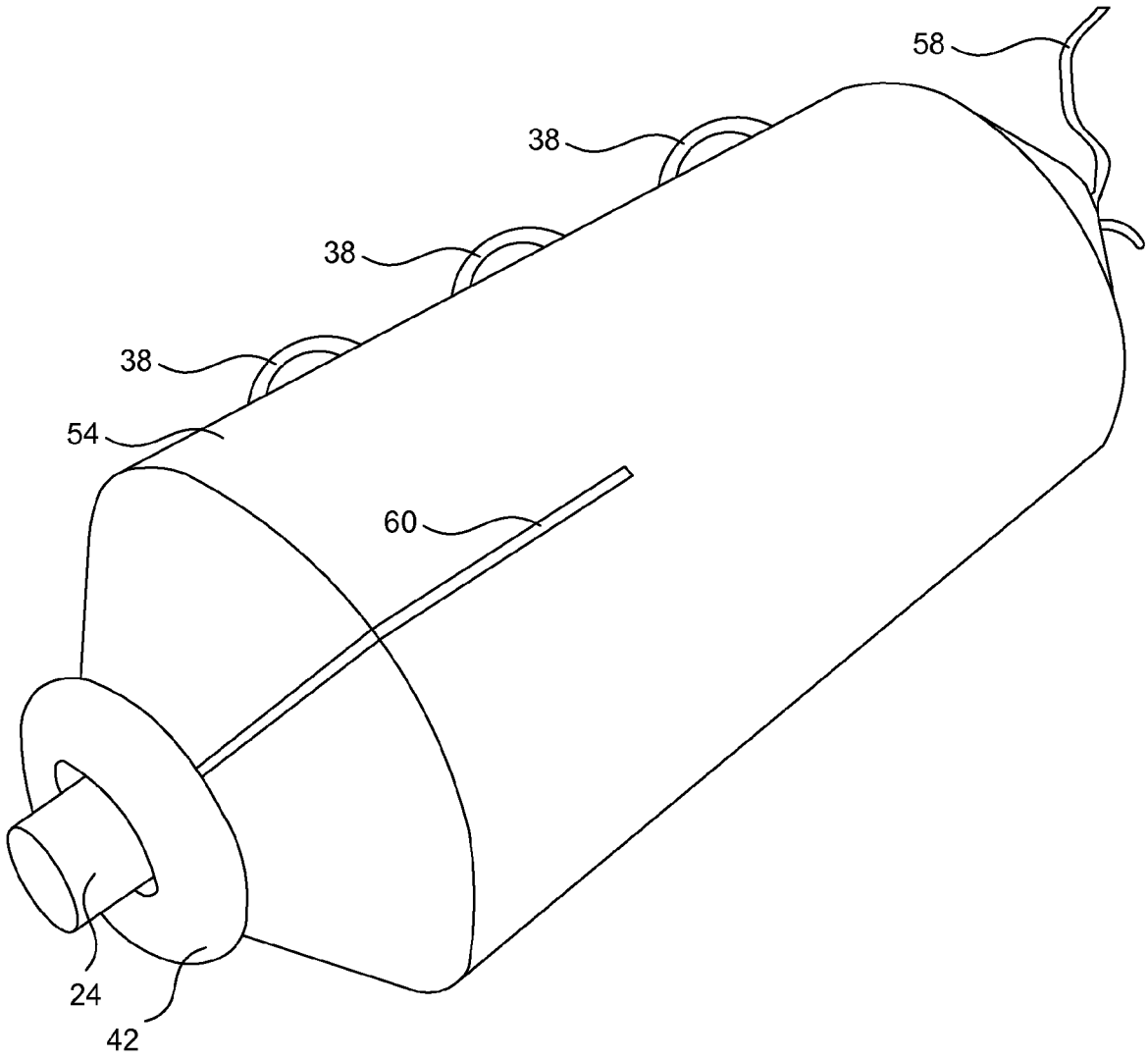
FIG. 10 provides a perspective illustration of a tree enclosed in a reusable tree bag in a horizontal position for removal of the tree bag.
Figure 11:
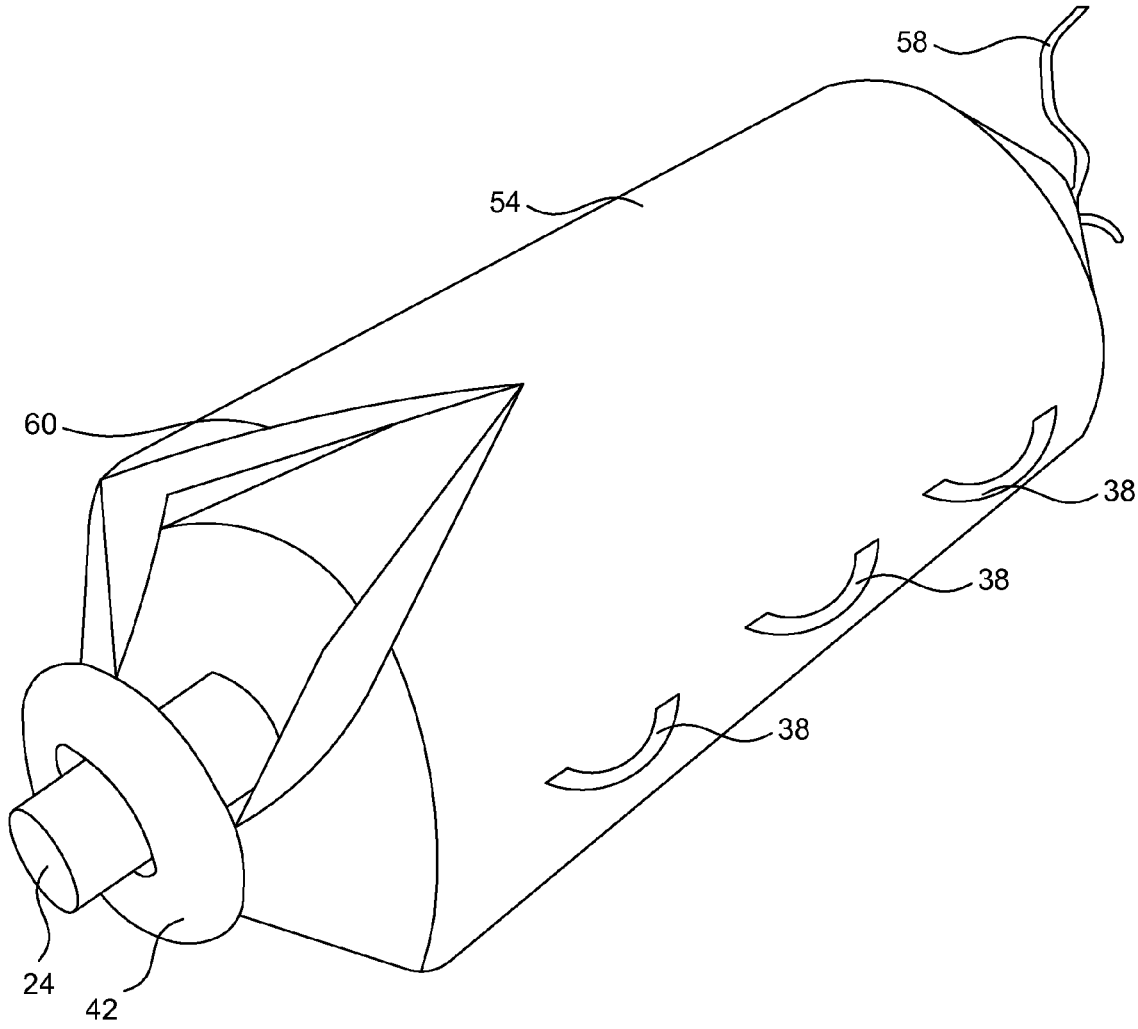
FIG. 11 shows a perspective illustration of an intermediate step in removing a tree bag from a tree.
Figure 12:
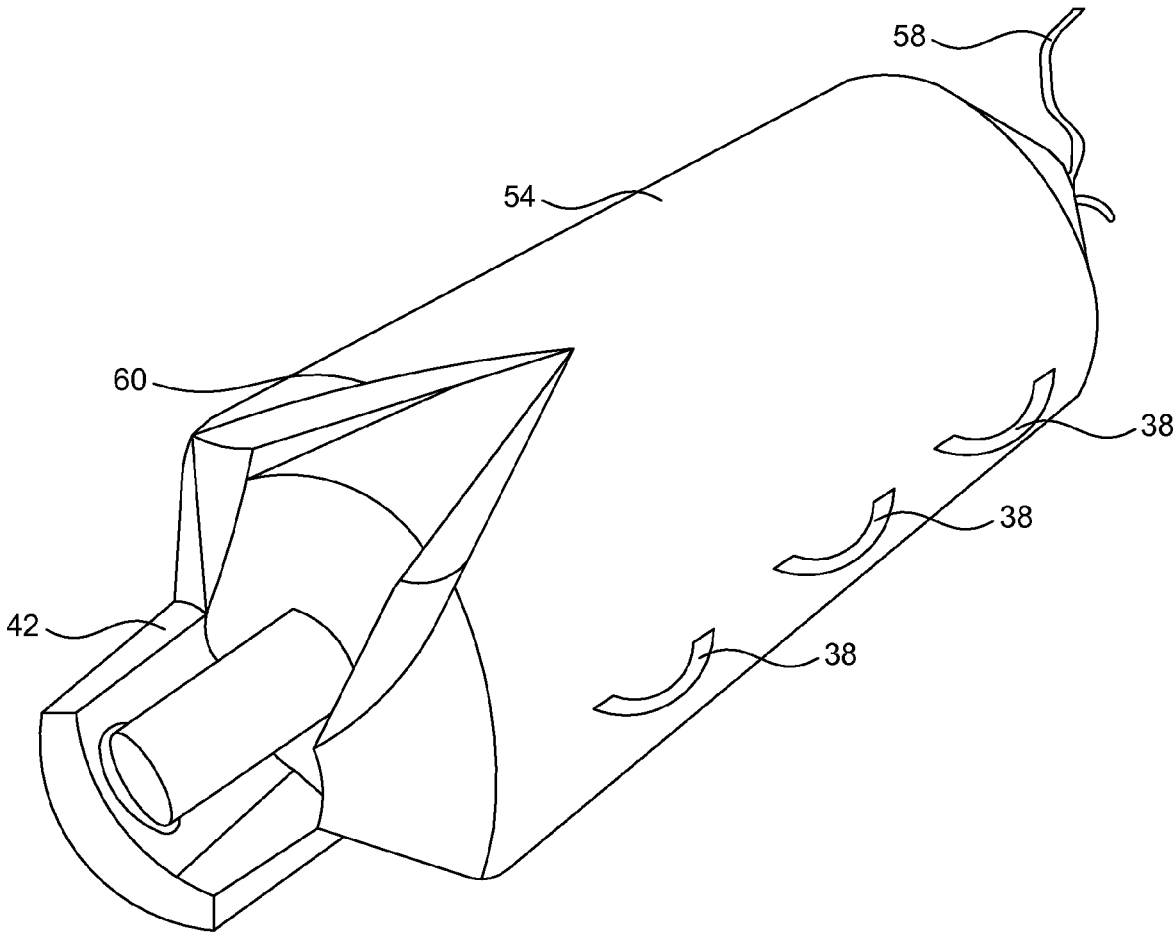
FIG. 12 shows a perspective view of another intermediate step in removing a tree bag from a tree.
Figure 13:
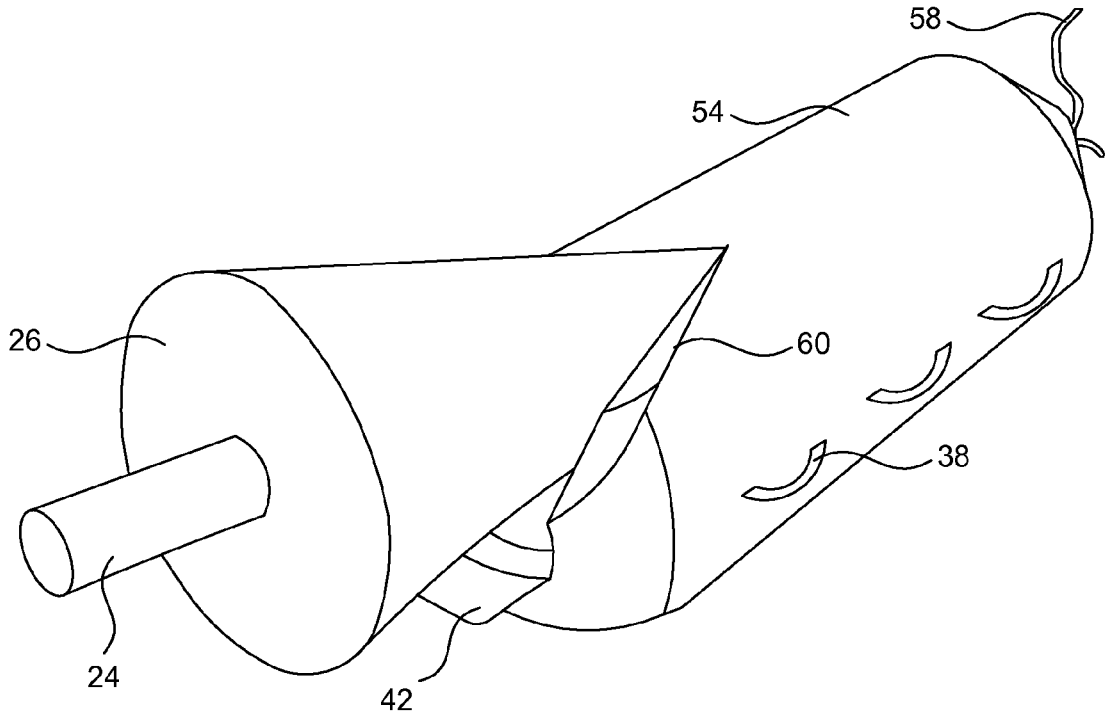
FIG. 13 shows a perspective view of a step in removing a tree from a tree bag.

The process of upward removal may be appreciated from the illustrations of FIGS. 10-13. The bag-enclosed tree is shown in FIG. 10 in a substantially-horizontal position. It will be appreciated that removal of the tree bag 54 may be done with the tree 26 in an upright position, but some of the steps may be more difficult in an upright position. As shown in FIG. 11, the lower vertical opening 60 is then opened to show a lower portion of the tree. Then, as illustrated in FIG. 12, the pouch 42 may be stretched out and down so as to pass over the trunk 24. This step releases the tree 26 so that it can move out of the tree bag 54, as illustrated in FIG. 13. It should be appreciated that alternatively the step of passing the pouch 42 over the trunk 24 may occur before the step of opening the lower vertical opening 60 as the tree is released and removed. Once the tree 26 has been removed from the tree bag 54, the tree 26 may be disposed of or displayed further, and the tree bag 54 may be laundered as necessary and stored until it is needed again. Alternatively, the tree bag 54 may be disposed of separately (such as where the tree 26 is recycled but the tree bag 54 cannot be recycled in the same way).

Thus, as discussed herein, some embodiments of the present invention relate to a disposable tree bag and cover system, and other embodiments relate to a reusable tree bag and cover system. More particularly, embodiments of the present invention relates to a tree bag configured for efficient transportation and disposal of a tree while catching and securing any shed leaves or needles. Still other embodiments relate to a reusable tree bag and cover system that minimizes undesirable application of force to the branches of the tree in undesirable directions. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A reusable tree storage and transportation bag for containing tree leaves and needles during transport and disposal and for containing artificial trees comprising:

a storage pouch configured to store a bag and configured to fit around a trunk of a tree; and a tree bag configured to substantially enclose the tree, the tree bag comprising:

a base opening attached to the storage pouch;

sides extending outward and upward from the base opening;

a substantially-circular top opening large enough to permit the top opening to pass around the branches of the tree as the top opening is drawn vertically from the bottom of the tree to the top of the tree; and a lower opening extending upward from the storage pouch along the tree bag and sized to permit passage of the tree through the lower opening;

wherein the storage pouch and the tree bag are configured so as to be able to assume at least two configurations: a first stored configuration wherein the tree bag is contained within the storage pouch, and a second deployed configuration wherein the bag is extended from the storage pouch upward and outward to form the tree bag, and wherein the storage pouch is sufficiently elastic to permit the storage pouch to be stretched and pulled over the bottom of the trunk of the tree when the tree bag is in the second deployed configuration substantially enclosing the tree, whereby the tree may be removed through the lower opening of the tree bag.

2. The bag of claim 1 further comprising handles attached to the bag for at least one of:

facilitating changing the bag between the stored and deployed configurations; and facilitating handling of the tree within the tree bag.

3. The bag of claim 1 wherein the storage pouch is circular in shape with a hole passing through the pouch configured to accept the passage of the trunk of the tree.

4. The bag of claim 3 wherein the storage pouch comprises:

a pouch shaped to form a storage area in the shape of a donut; and an upper half center hole configured to encircle the trunk and further configured to provide circular access to the contents of the pouch.

5. The bag of claim 4 wherein the upper half center hole comprises an elastic closing mechanism that biases the upper half center hole closed around the trunk.

6. The bag of claim 1 wherein the base opening of the tree bag is attached to the storage pouch at only a portion of the base opening and at only a portion of the storage pouch.

7. The bag of claim 1 whereby the attachment of the base opening to the storage pouch permits the storage pouch freedom to be stretched over the bottom of the trunk when the tree bag is in the second deployed configuration.

8. The bag of claim 1 wherein the storage pouch and the bag are made from materials selected from the group of plastic, fabric, and cloth.

9. The bag of claim 1 wherein the lower opening of the tree bag is a substantially-vertical opening.

10. A method of containing shed needles and leaves of a tree in a reusable tree bag during transport and disposal or for containing and storing an artificial tree, the method comprising:

providing a tree;

providing an elastic storage pouch about a trunk of the tree, the storage pouch containing an attached tree bag, the tree bag configured to extend upward and outward from the storage pouch and the trunk to substantially enclose the tree within the tree bag, the tree bag comprising a top opening sized so as to allow passage of the opening around the branches of the tree and a lower opening extending upward from the storage pouch along the tree bag and sized to permit passage of the tree through the lower opening;

opening the storage pouch by stretching an upper opening of the storage pouch, thereby exposing the tree bag;

extending the tree bag outward and upward from the storage pouch about the trunk of the tree until the branches of the tree are contained within the tree bag; and closing the top opening.

11. The method of claim 10, further comprising:

opening a lower opening of the tree bag;

stretching the storage pouch and pulling a portion of the storage pouch downward over the trunk of the tree, whereby the storage pouch no longer encircles the trunk; and removing the tree from the tree bag through the lower opening whereby the tree moves downward relative to the tree bag.

12. The method of claim 11, further comprising transporting the tree within the tree bag.

13. The method of claim 11, further comprising storing the tree within the tree bag.

14. A reusable tree storage and transportation bag for containing tree leaves and needles during transport and disposal or for storing an artificial tree comprising:

a storage pouch configured to store a bag and configured to fit around a trunk of a tree, the storage pouch comprising:

an upper half center hole and a lower half center hole configured to encircle the trunk of the tree; and a body for storing a bag when the bag is not in use;

the bag configured to substantially enclose the tree, the bag comprising:

a base opening attached to the storage pouch;

sides extending outward and upward from the base opening;

a lower opening extending upward from the base opening and sized to permit passage of the tree through the lower opening; and a substantially-circular top opening large enough to permit the top opening to pass around the branches of the tree as the top opening is drawn vertically from the bottom of the tree to the top of the tree;

means for closing the top opening;

wherein the storage pouch and the bag are configured so as to be able to assume at least two configurations: a first stored configuration wherein the bag is contained within the storage pouch, and a second deployed configuration wherein the bag is extended from the storage pouch upward and outward to substantially enclose the tree, and wherein the storage pouch is sufficiently elastic to permit the storage pouch to be stretched and pulled over the bottom of the trunk of the tree when the tree bag is in the second deployed configuration substantially enclosing the tree, whereby the tree may be removed through the lower opening of the tree bag.

15. The bag of claim 14 wherein the upper half center hole and the lower half center hole comprise elastic closing mechanisms that bias the upper half center hole and the lower half center hole closed around the trunk.

16. The bag of claim 14 wherein the base opening of the tree bag is attached to the storage pouch at only a portion of the base opening and at only a portion of the storage pouch.

17. The bag of claim 14 whereby the attachment of the base opening to the storage pouch permits the storage pouch freedom to be stretched over the bottom of the trunk when the tree bag is in the second deployed configuration.

18. The bag of claim 14 wherein the lower opening of the tree bag is a substantially-vertical opening.

* * * * *